US005572887A

United States Patent [19]

Geswelli

[11] Patent Number: 5,572,887

[45] Date of Patent: Nov. 12, 1996

[54] MAGNETIC JEWELRY CHAIN CLOSURE

[75] Inventor: James Geswelli, Florham Park, N.J.

[73] Assignee: Ultimate Trading Corporation, Roseland, N.J.

[21] Appl. No.: 489,265

[22] Filed: Jun. 9, 1995

[51] Int. Cl.[6] ..... A44C 5/00

[52] U.S. Cl. ..... 63/3; 24/303

[58] Field of Search ..... 63/3; 403/DIG. 1, 403/340; 24/303, 71 J, 265 WS, 616; 292/251.5

[56] References Cited

U.S. PATENT DOCUMENTS

| | | | |
|---|---|---|---|
| 2,750,828 | 6/1956 | Wendling | 403/DIG. 1 |
| 4,982,581 | 1/1991 | Furuyama | 24/303 X |
| 5,008,984 | 4/1991 | Levy | 24/303 |
| 5,311,647 | 5/1994 | Levy | 24/616 X |
| 5,367,891 | 11/1994 | Furuyama | 63/3 X |

*Primary Examiner*—Joanne Silbermann
*Attorney, Agent, or Firm*—Caesar, Rivise, Bernstein, Cohen & Pokotilow, Ltd.

[57] ABSTRACT

A jewelry chain having a pair of ends and a closure for releasably securing the ends together. The closure includes a male and a female component, each fixedly secured to a respective end of the chain. The male component includes a base member from which a circular disk of permanent magnetic material projects upward, a first tab and a first recess. The first tab projects outward from the base member perpendicular to the central axis adjacent a portion of the periphery of the disk, while the first recess projects outward from the base member perpendicular to the central axis adjacent a diametrically opposed portion of the disk. The female component includes a base member having a circular well of ferromagnetic material therein, a second tab, and a second recess. The second tab projects outward perpendicular to the central axis from the a portion of base member adjacent one portion of the periphery of the well while the second recess projects outward from the base member perpendicular to the central axis adjacent a diametrically opposed portion of the well. The disk of the male component is received within the well of the female component so that the components can be rotated with respect to each other to cause the first tab to enter the second recess while the second tab enters the first recess, thereby mechanically securing the components together.

13 Claims, 1 Drawing Sheet

MAGNETIC JEWELRY CHAIN CLOSURE

BACKGROUND OF THE INVENTION

This invention relates generally to jewelry, and more particularly to jewelry chains, necklaces, and the like having releasably securable closures.

Many types of closures or clasps for releasably securing the ends of jewelry chains, necklaces and the like together are found in the prior art. Such releasable closures or clasps typically comprises a pair of components, each of which is fixedly secured to a respective end of the chain or necklace. The two components are arranged to be releasably secured together, e.g., mate with each other, to hold the chain or necklace in place against accidental disconnection. Some prior art chain or necklace closures have included magnetic means for releasably securing the two components of the closure together. Examples of such prior art magnetic closures are found in U.S. Pat. Nos. 2,615,227 (Hornik), 3,108,346 (Bey), 4,426,854 (Geldwerth et al.), 4,901,405 (Grover et al.), and 5,050,276 (Pemberton). Magnetic closures, locks, or snaps have also been disclosed in the patent literature for use in handbags and purses to close the handbag or purse, e.g., U.S. Pat. Nos. 4,021,891 (Morita), 4,200,852 (Aoki), 4,700,436 (Morita), and 5,142,746 (Morita).

While the prior art magnetic closures may be suitable for their intended purposes, they never the .less leave much to be desired from the standpoint of simplicity of construction, ease of use, resistance to accidental opening, and aesthetics.

OBJECTS OF THE INVENTION

Accordingly, it is a general object of this invention to provide a closure for jewelry chain, necklace or the like, which overcomes the disadvantages of the prior art and which addresses the needs of the jewelry industry.

It is another object of this invention to provide a magnetic closure or clasp for jewelry chains, necklaces, and the like which is simple in construction.

It is still another object of this invention to provide a magnetic closure or clasp for jewelry chains, necklaces, and the like which is easy to use.

It is still another object of this invention to provide a magnetic closure or clasp for jewelry chains, necklaces, and the like which is resistant to accidental disconnection.

It is still another object of this invention to provide a magnetic closure or clasp for jewelry chains, necklaces, and the like which is compact in size.

It is yet another object of this invention to provide a magnetic closure or clasp for jewelry chains, necklaces, and the like which is simple in construction, easy to use, resistant to accidental disconnection, yet which is aesthetically pleasing.

SUMMARY OF THE INVENTION

These and other objects of this invention are achieved by providing a closure for a jewelry chain, necklace or the like. The chain or necklace has a pair of ends. The closure comprises a pair of mating first and second components, with the first component being fixedly secured to one end of the chain or necklace, and with the second component being fixedly secured to the other end of the chain or necklace.

The first component comprises a projection, e.g. a disk of circular profile, having a first central axis. The second component comprises a circular well having a second central axis. One of the first and second components comprises a tab extending perpendicular to the central axis thereof and the other of the first and second components comprises a recess extending perpendicular that component's central axis. The projection of the first component is arranged to be magnetically received within the well of the second component, with the first and second central axes thereof being coincident or coaxial.

The first and second components are rotatable with respect to each other about the coincident axes while the projection of the first component is magnetically received within the well of the second component to cause the tab of one component to enter the recess of the other component to mechanically releasably secure the first and second components together.

In accordance with a preferred embodiment of this invention the first component comprises a first base member from which the projection projects, a first tab and a first recess. The first tab projects outward perpendicularly to the first central axis from a portion of the first base member adjacent one portion of the periphery of the projection. The first recess projects outward perpendicularly to the first central axis from a portion of the first base member disposed diametrically opposite to the first tab. The second component comprises a second base member into which the well extends, a second tab and a second recess. The second tab projects outward perpendicularly to the second central axis from a portion of the second base member adjacent one portion of the periphery of the well. The second recess projects outward perpendicularly to the second central axis from a portion of the second base member disposed diametrically opposite to the second tab. The first and second components are rotatable with respect to each other about their coincident axes while the projection is magnetically received within the well to cause said first tab of the first component to enter the second recess of the second component while the second tab of the second component enters the first recess of the first component, thereby mechanically releasably securing said first and second components together.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
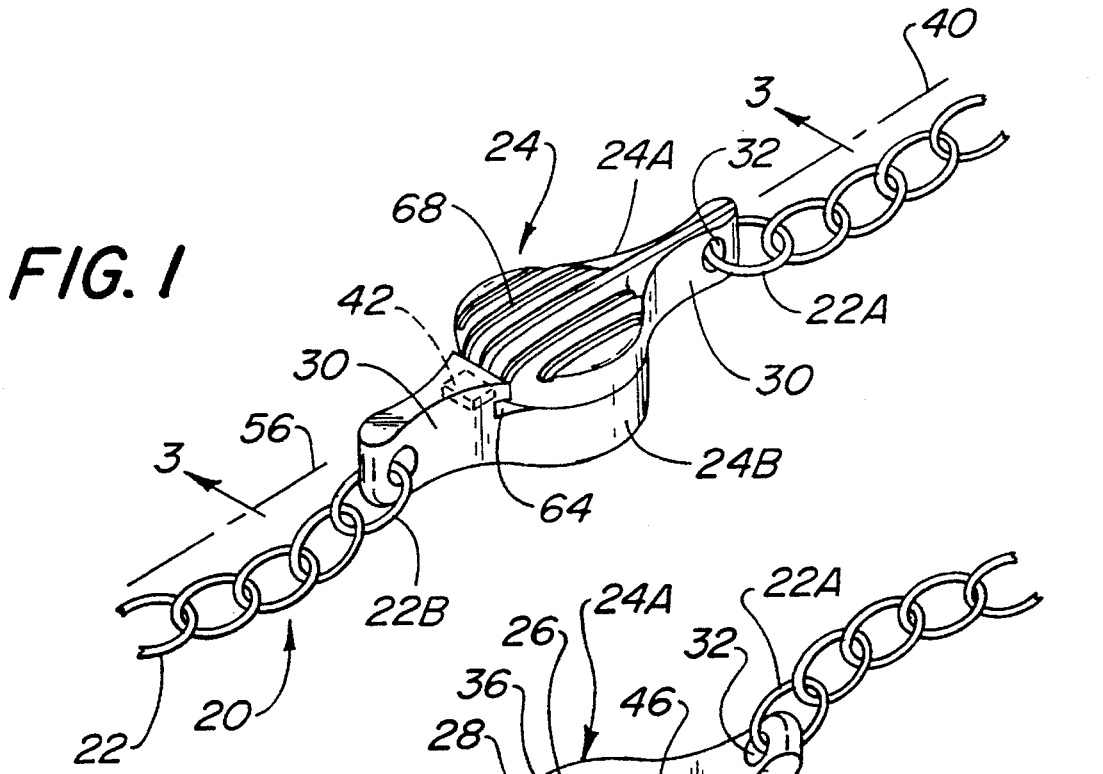
FIG. 1 is an isometric view of a jewelry item in the form of a link chain and closure constructed in accordance with this invention, with the two components making up the closure being shown secured together.

Referring now to various figures of the drawing where like reference numerals refer to like parts there is shown at 20 in FIG. 1, a jewelry item, e.g., a chain, necklace or the like, constructed in accordance with this invention. The jewelry item 20 basically comprises an elongated flexible member 22, in this case a chain of plural interconnected ring-like links. The chain has a pair of ends 22A and 22B, each of which is defined by the end-most link of the chain. The ends 22A and 22B of the chain are arranged to be releasably secured together by means of a closure or clasp 24 constructed in accordance with this invention in order to secure the jewelry item onto a portion of the body, e.g., neck, wrist, etc., of the wearer (not shown).

The closure/clasp basically comprises a pair of components 24A and 24B, which are fixedly secured to the links forming the ends 22A and 22B, respectively, of the chain 22. Before describing the details of the components making up the closure assembly, it should be pointed out that the chain 22 is merely exemplary of various types of jewelry items which can be made using the teachings of this invention. Thus, the item 22 can be of any type of construction and/or appearance, e.g., a chain of multiple links (like that shown), a rope (not shown) or strand (not shown) of some aesthetically pleasing material, or some other construction having a pair of ends to be connected together to encircle a portion of the body of a person, depending upon the aesthetics desired.

As will be set forth later, the components 24A and 24B making up the closure 24 include some basic structural features 9 to be described hereinafter) which provide the functionality for the closure. Except for those structural features which are dictated by function, the shape, surface appearance, and composition of material(s) making up the components 24A and 24B may be selected as desired in the interests of aesthetics, i.e., to provide the desired aesthetic appearance.

The details of the components 24A and 24B will be considered shortly. Suffice it for now to state that the component 24A of the closure 24 includes a projecting or "male" portion (to be described later) for mating with a recess or "female" portion of the component 24B to magnetically releasably secure those components together. This action establishes a temporary securement of the components 24A and 24B together. Once the temporary magnetic securement has been accomplished the two components 24A and 24B can be oriented with respect to each other while in magnetic engagement so that other portions (also to be described later) of those components interlock mechanically. This mechanical interlocking finishes the securement of the closure, i.e., it accomplishes a reliable and assured securement of the components of the closure to each other which is resistant to accidental disconnection, but can be readily disconnected by appropriate manipulation of the closure's components, when desired.

As can be seen in the drawings the components 24A and 24B are of generally similar construction. In this regard each component includes a base portion 26, which in the exemplary embodiment shown herein is of a generally tear-drop shape, having a rounded end 28 and an opposed tapering end 30. The tapering end 30 includes any suitable means, e.g., a hole 32, for fixedly securing it to the link at an associated end 22A or 22B of the chain 22.

The base portion 26 at the tear drop shaped end of the component 24A includes a male member or projection 34 extending upward from the top surface 36 thereof. The projection is in the form of a circular disk fixedly secured, e.g., adhesively secured, within a correspondingly shaped well in the base portion of the component. The disk may be of other regular geometric shapes, e.g., a square, an equilateral triangle, a pentagon, an octagon, etc., In the exemplary preferred embodiment the disk is formed of a permanent magnetic material and projects out of the well above the top surface 36 of the base portion and has a central axis 38 (FIGS. 2 and 3) extending perpendicularly to the longitudinal axis 40 (FIG. 1) of the component 24A. The top surface of the disk 34 is planar.

The free end of the component 24A includes a generally planar tab 42 projecting outward from that end. The tab 42 extends perpendicularly to the axis 38 of the disk 34 and is located adjacent a portion of the disk's periphery. The tapering end 30 of the component 24A includes an upstanding wall 44 having an undercut recess or slot 46 extending fully across the front face 48 of the wall. The recess or slot 46 is located closely adjacent a portion of the periphery of the disk 34 which is diametrically opposite to the tab 42.

Figure 2:
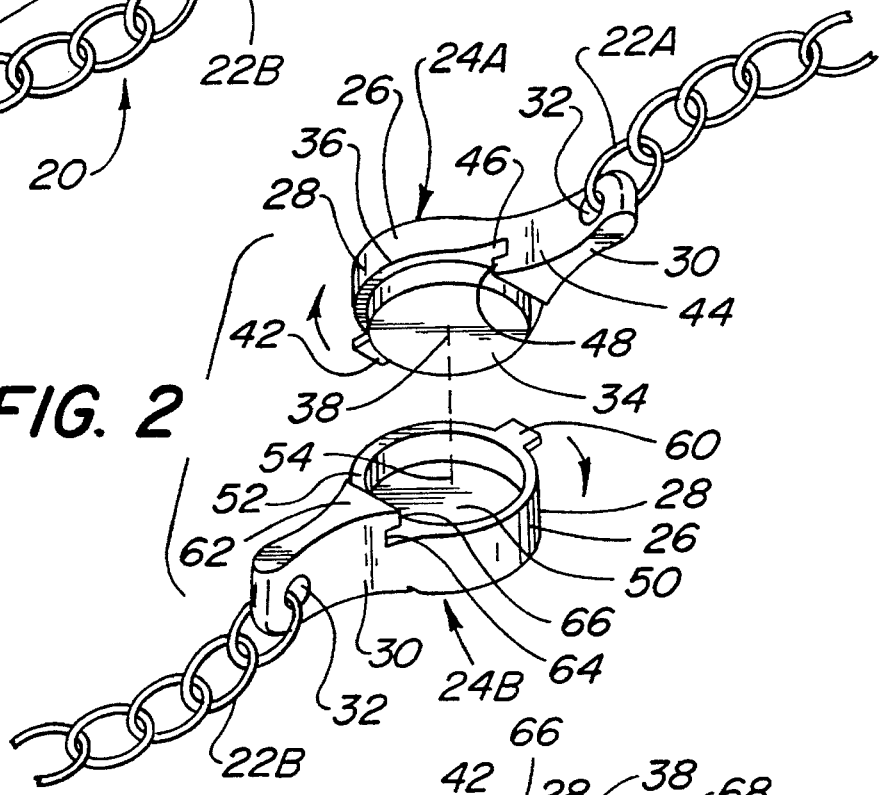
FIG. 2 is an isometric view of the jewelry item of FIG. 1 but showing the two components making up the closure prior to being secured together.
Figure 3:
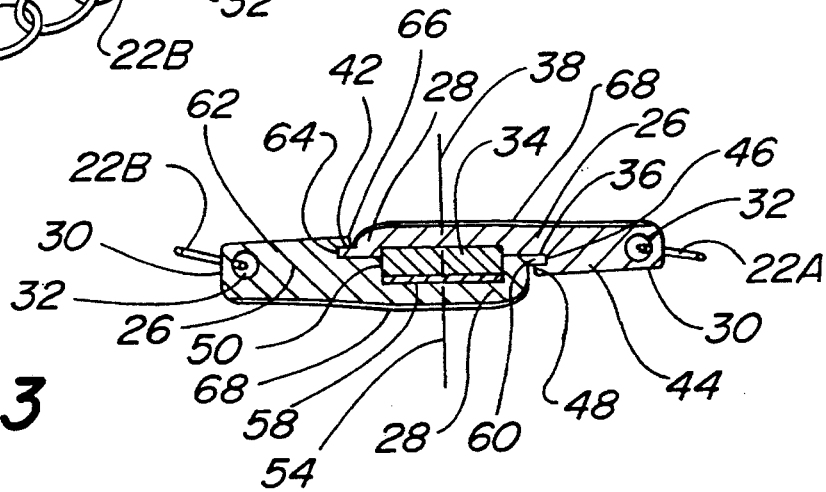
FIG. 3 is a sectional view taken along line 3—3 of FIG. 1.

The base portion 30 at the tear drop shaped end of the component 24B includes a female member or well 50 extending downward from the top surface 52 thereof. The well is circular in shape to receive the projection 34 and thus extends about a central axis 54 (FIGS. 2 and 3). The central axis 54 extends perpendicularly to the longitudinal axis 56 (FIG. 1) of the component 24B. The bottom surface of the well 50 is in the form of a thin planar circular disk 58 (FIG. 3) of a ferromagnetic material. The disk 58 is fixedly secured within the well by any suitable means, e.g., an adhesive (not shown). The well 50 is sized to receive therein the projecting disk 34 of the component 24A so that the top wall of the disk magnetically engages the ferromagnetic disk 58 in the well, with the central axes 38 and 54 being coaxially aligned as shown in FIG. 3 and so that the two components can be rotated with respect to each other about their axially aligned axes for reasons to be discussed later.

The free end of the component 24B includes a generally planar tab 60, like the tab 48, projecting outward from that end. The tab 60 extends perpendicularly to the axis 54 of the well 50 and is located adjacent a portion of its periphery. The tapering end 30 of the component 24B includes an upstanding wall 62 having an undercut recess or slot 64 (like the slot 46) extending fully across the front face 66 of the wall 62. The recess or slot 64 is located closely adjacent a portion of the peripheral sidewall of the well diametrically opposite to the location of the tab 60.

In the interests of aesthetics the exposed or outer surfaces of the closure components 24A and 24B may be coated with an aesthetically pleasing material, e.g., a precious metal coating 68 (FIGS. 1 and 3). That coating may include surface features, e.g., grooves as shown, in the interests of aesthetics.

It should be pointed out at this juncture that while the exemplary preferred embodiment of this invention makes use of a male component having a disk 34 of a permanent magnetic material adhesively secured within a well, the subject invention is not limited to only that construction. In this regard the projection, e.g., disk, may form a unitary portion the component, e.g., the entire component 24A may be formed of a permanent magnetic material. Further still, the well 50 may be constructed to obviate the use of a separate disk of a ferromagnetic material secured at the bottom of the well. In this regard, the ferromagnetic material which is magnetically engaged by the projection 34 may be in the form of a unitary portion the female component itself, e.g., the entire component 24B may be formed of a ferromagnetic material. In fact, the well 60 of the female component 24B can be constructed so that its bottom wall is formed of a permanent magnetic material, while the projection or disk 34 of male component 24A is formed of a ferromagnetic material. Moreover, both the well and the projection can be formed of a permanent magnetic material so long as their poles are opposed to permit magnetic attraction therebetween. Further still, as mentioned earlier the projection or disk 34 need not be of circular profile, but can be of any regular geometric shape so long as its periphery engages the periphery of the well to enable the two components to be rotated about their coaxial axes relative to each other to facilitate the mechanical connection and disconnection of those components to each other (as will be described hereinafter).

The securement of the male and female components 24A and 24B, respectively, together will now be described. To that end the user orients places the chain 22 about the portion of his/her body on which the item is to be worn. Then the two components 24A and 24B are manipulated into the orientation shown in FIG. 3. In this orientation the projection or disk 34 of the male component 24A faces the well 50 of the female component 22B, with their respective central axes 38 and 54 coaxially aligned, but with their respective longitudinal axes 40 and 56 extending perpendicularly to each other. The two components are then brought together so that the projection or disk 34 of the male component 24A enters the well 50 of the female component 24B, with the tabs 42 and 60, respectively, being directed perpendicular to each other. The magnetic attraction between the projection or disk 34 and the disk 58 causes the male component 34 to magnetically engage the disk 58 in the well 50 of the female component 24B, thereby temporarily securing the components together.

In order to effect the complete securement of those components together they are then rotated with respect to each other about their coaxial axes 38 and 54 in the directions of the arrows in FIG. 3 until the tab 42 of the male component 24A enters the slot 64 in the female component 24B and the tab 60 of the female component 24B enters the slot 46 in the male component 24A. Once this has occurred the two components are not only magnetically secured, but also mechanically secured by the engaging tabs and slots. The temporary magnetic securement provided by the components facilitates the process of mechanically securing them together and, in fact, is sufficient to hold the components together against accidental disconnection even if there would be no mechanical securement. However, the additional securement provided by the mechanical interlocking of the tabs and slots ensures that the closure does not become disconnected accidentally even if the components are impacted or disturbed. When disconnection is desired all that is required is for the wearer to rotate the two components with respect to each other about their axes 38 and 54 so that the tabs exit the slots in which they had been located. Once the tabs are free of the slots the closure components can be pulled apart in directions parallel to those axes to disconnect the magnetic engagement between the components.

Without further elaboration the foregoing will so fully illustrate my invention that others may, by applying current or future knowledge, adapt the same for use under various conditions of service.

I claim:

1. A closure for a jewelry chain or necklace, the chain or necklace having a pair of ends, said closure comprising a pair of mating first and second components, said first component being arranged for being fixedly secured to one end of the chain or necklace and comprising a projection having a first central axis, said second component being arranged for being fixedly secured to the other end of the chain or necklace and comprising a circular well having a second central axis, one of said first and second components comprising a tab fixedly positioned with respect thereto and extending in a plane perpendicular to said central axis thereof, and the other of said first and second components comprising a recess extending in a plane perpendicular to said central axis thereof, said projection being arranged to be magnetically received within said well with said first and second central axes being substantially coincident and with said tab and said recess being in a common plane, said first and second components being rotatable with respect to each other about said coincident axes to a predetermined orientation while said projection is magnetically received within said well, whereupon said rotation of said first and second components with respect to each other to said predetermined orientation automatically causes said tab of said one component to enter said recess of said other component to mechanically releasably secure said components together.

2. The closure of claim 1 wherein said first component comprises a first base member from which said projection projects, a first tab and a first recess, said first tab projecting outward perpendicularly to said first central axis from a portion of said first base member adjacent one portion of the periphery of said projection, said first recess projecting outward perpendicularly to said first central axis from a portion of said first base member disposed diametrically opposite to said first tab, said second component comprising a second base member into which said well extends, a second tab and a second recess, said second tab projecting outward perpendicularly to said second central axis from a portion of said second base member adjacent one portion of the periphery of said well, said second recess projecting outward perpendicularly to said second central axis from a portion of said second base member disposed diametrically opposite to said second tab, said first and second components being rotatable with respect to each other about said coincident axes while said projection is magnetically received within said well to cause said first tab of said first component to enter said second recess of said second component while said second tab of said second component enters said first recess of said first component, thereby mechanically releasably securing said first and second components together.

3. The closure of claim 2 wherein said projection is formed of a permanent magnetic material, and wherein said well is formed of a ferromagnetic material.

4. The closure of claim 2 wherein each of said base members is an elongated member having a free end and an opposite end, wherein the opposite end of each of said base members is fixedly secured to a respective end of the chain or necklace.

5. The closure of claim 4 wherein said free end of said first base member includes said first tab located thereat, and wherein said free end of said second base member includes said second tab located thereat.

6. The closure of claim 1 wherein said projection is formed of a permanent magnetic material, and wherein said well is formed of a ferromagnetic material.

7. The closure of claim 1 wherein each of said base members is an elongated member having a free end and an opposite end, and wherein the opposite end of each of said base members is fixedly secured to a respective end of the chain or necklace.

8. The closure of claim 1 wherein said projection is of circular profile.

9. A jewelry chain or necklace having a pair of ends and a closure for releasably securing said pair of ends together, said closure comprising a pair of mating first and second components, said first component being fixedly secured to one of said ends and comprising a projection having a first central axis, said second component being fixedly secured to the other of said ends and comprising a circular well having a second central axis, one of said first and second components comprising a tab fixedly positioned with respect thereto and extending in a plane perpendicular to said central axis thereof, and the other of said first and second components comprising a recess extending in a plane perpendicular to said central axis thereof, said projection being arranged to be magnetically received within said well with said first and second central axes being coincident and with said tab and said recess being in a common plane, said first and second components being rotatable with respect to each other about said coincident axes to a predetermined orientation while said projection is magnetically received within said well, whereupon said rotation of said first and second components with respect to each other to said predetermined orientation automatically causes said tab of one component to enter said recess of the other component to mechanically releasably secure said components together.

10. The jewelry chain or necklace of claim 9 wherein said first component comprises a first base member from which said projection projects, a first tab and a first recess, said first tab projecting outward perpendicularly to said first central axis from a portion of said first base member adjacent one portion of the periphery of said projection, said first recess projecting outward perpendicularly to said first central axis from a portion of said first base member disposed diametrically opposite to said first tab, said second component comprising a second base member into which said well extends, a second tab and a second recess, said second tab projecting outward perpendicularly to said second central axis from a portion of said second base member adjacent one portion of the periphery of said well, said second recess projecting outward perpendicularly to said second central axis from a portion of said second base member disposed diametrically opposite to said second tab, said first and second components being rotatable with respect to each other about said coincident axes while said projection is magnetically received within said well to cause said first tab of said first component to enter said second recess of said second component while said second tab of said second component enters said first recess of said first component, thereby mechanically releasably securing said first and second components together.

11. The jewelry chain or necklace of claim 10 wherein said projection is formed of a permanent magnetic material, and wherein said well is formed of a ferromagnetic material.

12. The jewelry chain or necklace of claim 9 wherein said projection is formed of a permanent magnetic material, and wherein said well is formed of a ferromagnetic material.

13. The jewelry chain or necklace of claim 9 wherein said projection is of circular profile.

* * * * *